US005431519A

United States Patent [19]

Baumann

[11] Patent Number: 5,431,519

[45] Date of Patent: Jul. 11, 1995

[54] SPREADING DEVICE FOR A BINDING APPARATUS AND COMBINED PUNCH AND BINDING APPARATUS

[75] Inventor: Benny Baumann, Baar, Switzerland

[73] Assignee: Ibico AG, Zurich, Switzerland

[21] Appl. No.: 132,596

[22] Filed: Oct. 6, 1993

[30] Foreign Application Priority Data

Oct. 12, 1992 [CH] Switzerland ..... 03182/92

[51] Int. Cl.[6] ..... B42B 9/00

[52] U.S. Cl. ..... 412/40; 412/7; 412/38

[58] Field of Search ..... 412/7, 16, 38, 39, 40; 83/549, 618, 630, 831, 934

[56] References Cited

U.S. PATENT DOCUMENTS 3,866,254 2/1975 Gronda ..... 412/40
3,967,336 7/1976 Cutter ..... 412/40 X
5,143,502 9/1992 Kaufmann et al. ..... 412/16
5,211,522 5/1993 Ho ..... 412/16
5,273,387 12/1993 Groswith, III et al. ..... 412/40

*Primary Examiner*—Tom Hughes
*Attorney, Agent, or Firm*—Stroock & Stroock & Lavan

[57] ABSTRACT

A spreading device is provided for a spreading and binding machine, to which several fixed spreading fingers are arranged at the side. These spreading fingers cooperate with corresponding spreading hooks of a movable plate, in order to move the spreading hooks from the spreading fingers in a spreading direction by moving the plate. The plate is connected through two pivotable and movable arms with an intermediate bar connected so that the arms and bar can move in both a spreading direction and in a direction perpendicular to the spreading direction in parallel movement. The bar is pivotally connected at each end with the two arms.

9 Claims, 4 Drawing Sheets

SPREADING DEVICE FOR A BINDING APPARATUS AND COMBINED PUNCH AND BINDING APPARATUS

BACKGROUND OF THE INVENTION

The invention relates to a spreading device for spreading clamping backs used in the binding of sheet and especially for a spreading device in a combined punch and binding machine.

Binding machines for binding paper sheets are highly desirable and useful office machines. Such binding apparatuses are widely utilized in professional offices for binding sheets utilized in reports, presentations and the like. These machines generally include a hole punching assembly and a binding section for binding with various types of binding strips such as the Personal VeloBinder or Douvry-type binding elements. These are described in U.S. Pat. No. 5,143,502. The binding apparatus for paper sheets illustrated in U.S. Pat. No. 5,143,502 includes binding blades for bending flexible studs of one binding strip which fit into grooves on a second aperatured binding strip through which the studs pass. This apparatus is complex, in that it includes a plurality of racks and gears. Accordingly, it is desirable to provide a binding apparatus including a spreading device of simplified construction.

SUMMARY OF THE INVENTION

Generally speaking, in accordance with the invention, a spreading device for spreading a spline or clamping back for sheets to be bound is provided. The spreading device includes a base with a plurality of parallel spreading fingers mounted thereon and a plurality of spreading hooks mounted on a movable ratchet in order to move the spreading hooks from the spreading fingers in a spreading direction by moving the ratchet. Each end of the ratchet is pivotally connected through two flexible and movable arms with a connecting bar so that the connecting bar and pivoting arms move in both a spreading direction and in a direction perpendicular to the spreading direction in parallel movement.

The object of the invention is that of creating a spreading device and binding apparatus including the device of the type mentioned, which is inexpensive and can easily be integrated into binding machines, especially office binding machines.

BRIEF DESCRIPTION OF THE DRAWINGS

The invention is illustrated in greater detail by a drawing, given as an example. The following features are represented.

DESCRIPTION OF THE PREFERRED EMBODIMENTS

Figure 1:
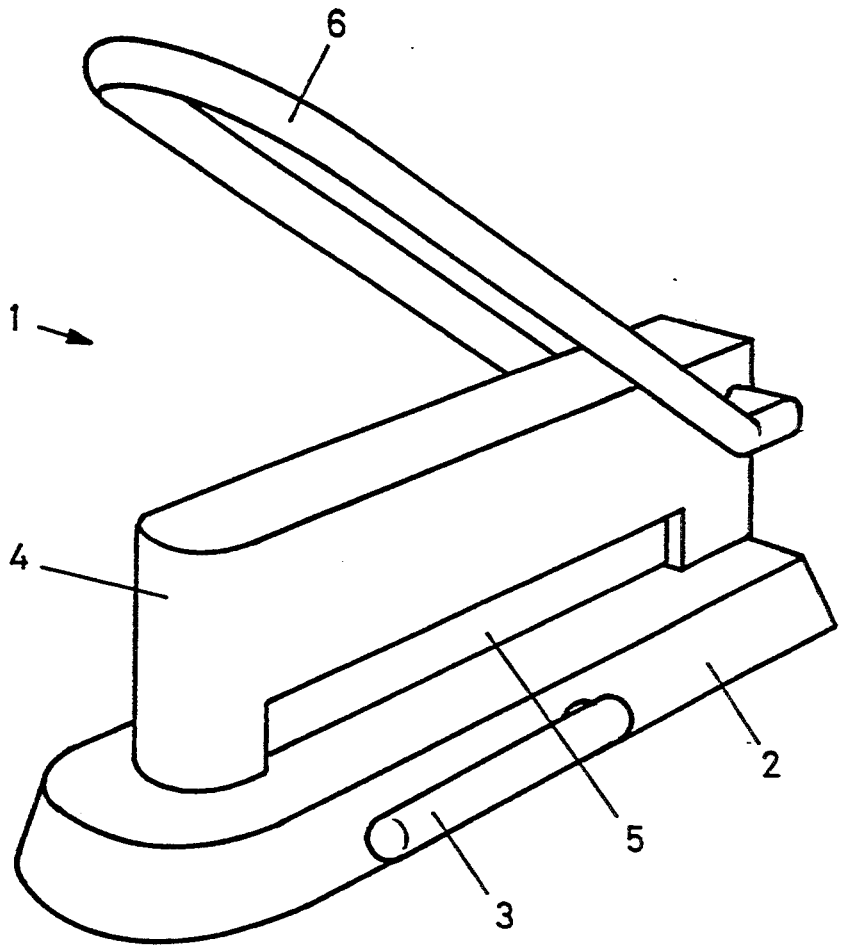
FIG. 1 is a perspective representation of a combined punch and binding machine with installed spreading device according to the invention.

A combined punch and binding machine 1 shown in FIG. 1 includes a base or bottom element 2 which serves as a support for carrying the various elements of machine 1. A spreader lever 3 is arranged on one side of bottom element 2. The elements of machine 1 are covered by a carrier casing 4. Casing 4 is formed with an elongated opening 5 aligning with the upper surface of bottom element 2, in which a wire binding back can be locked. In order to be able to produce holes conveniently in a stack of paper to be bound, machine 1 is provided with a strong punch lever 6. The axis of rotation of lever 6 is arranged in one end area of elongated carrier casing 4, parallel to the surface of bottom element 2.

The spreading device activated by spreader lever 3 projects from the other side of bottom element 2 and therefore is not visible in FIG. 1.

Figure 2:
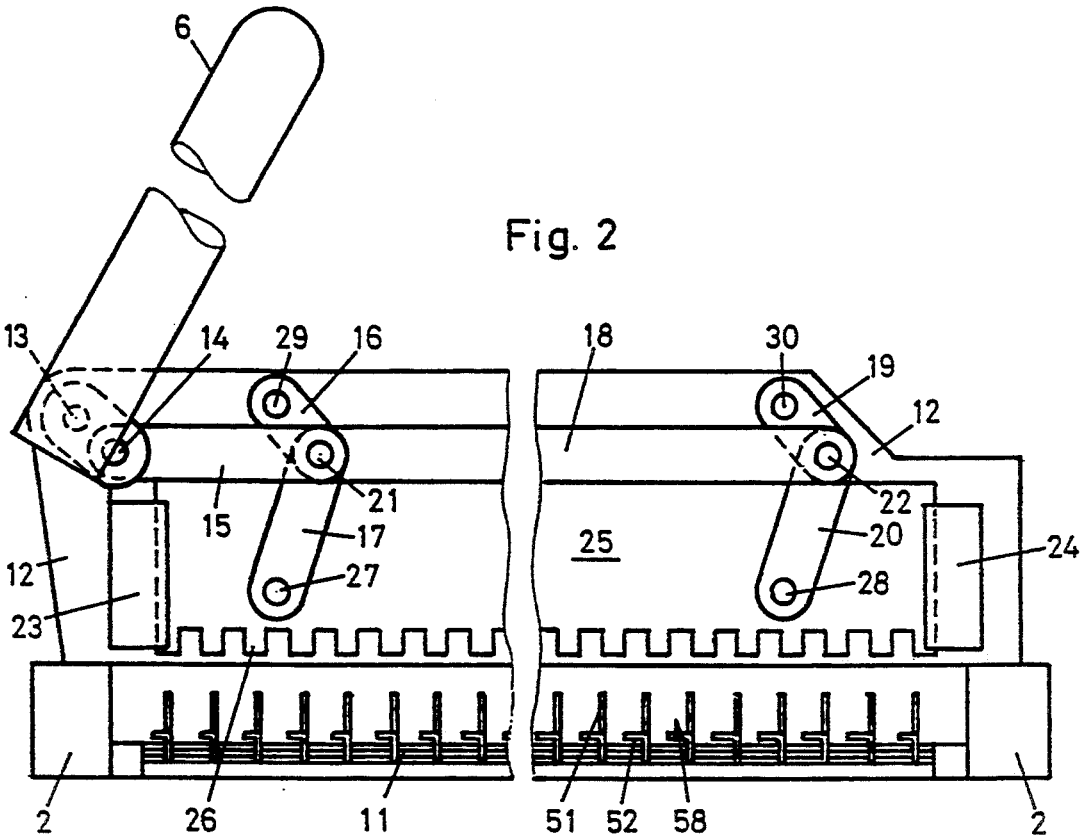
FIG. 2 is a side view of another design of a punch and binding machine with a spreading device according to the invention.

The spreading device includes a projecting element 11 which extends parallel to the bottom plane and is shown in FIG. 2. It can be seen that this design includes a carrier flange 12 connected with bottom body 2. This can be designed as an angle section, for example. Punch lever 6 is pivotally connected with the left upper end area of flat elongated angle section 12 by a first shaft 13, and by a second shaft 14 with a first lever arm 15 of a lever system which includes five other lever arms 16, 17, 18, 19, 20. Shaft 14 is connected to a connecting piece firmly attached to punch lever 6. One end of lever arm 18 is connected to lever arms 15, 16 and 17 by another shaft 21, and its other end with lever arms 19 and 20 by another shaft 22. Vertical guides 23 or 24 are attached to each of the left and right sides of the end areas of angle section 12, which permit a vertical movement of punching element 25 provided with N punch teeth 26.

Such a punching element can include twenty-one teeth for use in Europe and nineteen teeth for use in the United States. The sharp cutting edges of punch teeth 26 are not represented, to simplify the figure. Lever arms 17 and 20, through one of shaft 27 or 28 each, are thereby pivotally connected with the lower area of punching element 25, but above punch teeth 26. Lever arms 16 and 19 each through one of shaft 29 or 30 are connected with the upper area of angle section 12 in parallelogram form, since both the longitudinal axes of lever arms 17 and 20 and the longitudinal axes of lever arms 16 and 19 always run parallel.

Bottom element 2 includes an upper aligning floor plate **2*a*, which is provided with N punch holes, into which N punch teeth 26 penetrate during holing. To simplify the drawing, these known punch holes are not shown in FIG. 2**.

In the case of the device constructed and arranged in accordance with FIG. 2, punching element 25 is located in an upper position, in which punch level 6 is pulled up, as shown in the figure. In this position, the longitudinal axes of lever arms 16 and 17 or lever arms 19 and 20 form an angle of more than 90°. When punch lever 6 is rotated downward around axis of rotation 13, lever arms 15 and 18 move to the left (FIG. 2) and somewhat downward. Punching element 25 is thereby pressed downward through shafts 27 and 28 by levers 17 and 20, so that punch teeth 26 are introduced into the punch holes.

Figure 3:
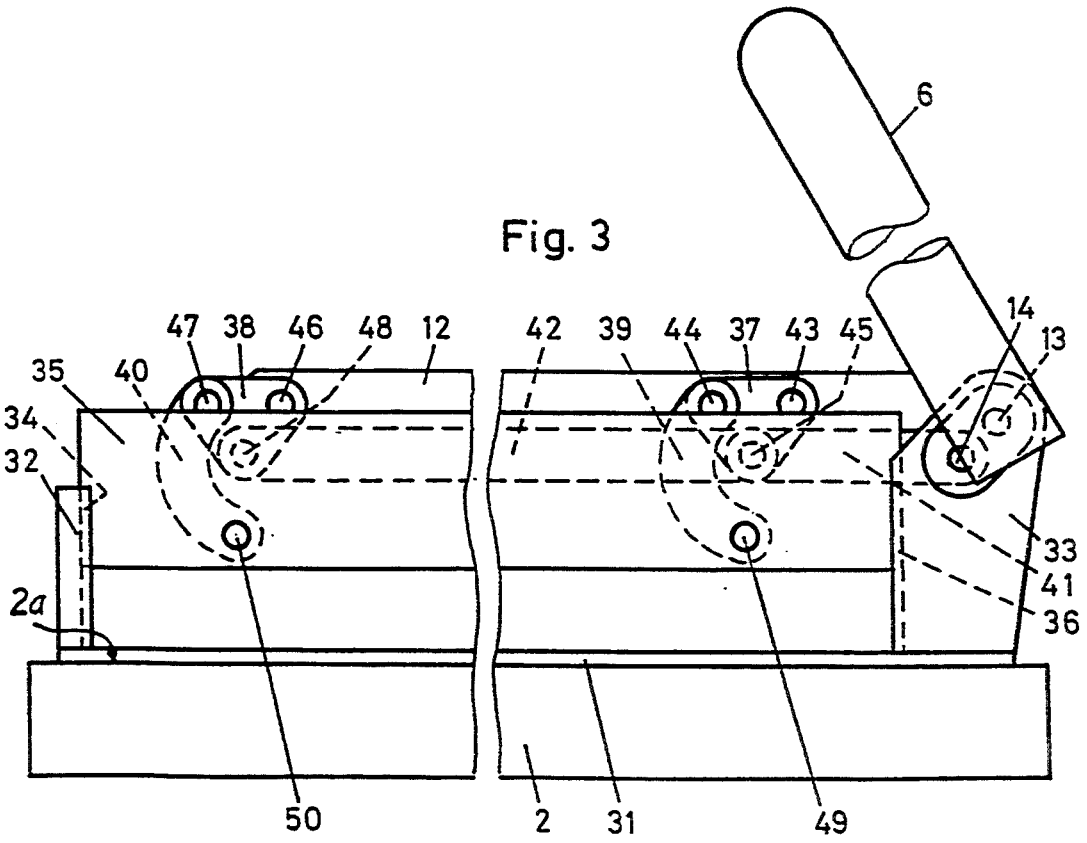
FIG. 3 is a view from the other side of this punch and binding machine of FIG. 2, to illustrate an additional function of same to close clamping backs.

The spreading lever is not shown in FIG. 3 to simplify the drawing. It should be present at this side of bottom element 2, if the machine is provided with the type of spreading device shown in FIG. 1. The edge of the elongated horizontally flat part 31 of angle section 12 designed in L-shape is visible in FIG. 3 in cross-section. Guide block 32 at the left and thrust block 33 at the right are attached to the end areas of part 31, for example by means of screws not shown in the figure. Guide block 32 includes a groove 34, which serves as a guide for the left side of a pressing element 35, and thrust block 33 together with a sheet attached to it at the rear form a groove 36, provided for the right side of pressing element 35.

Pressing element 35 is an angle section, L-shaped in cross-section, with a vertical part visible in FIG. 3, and a horizontal part, whose length, in horizontal direction, is somewhat shorter than the length, in horizontal direction, of the vertical part, so that the ends of this vertical part can glide in grooves 34 and 36. In FIG. 3, pressing element 35 partially covers another lever system, including two triangular levers 37, 38, two curved levers 39, 40, and two flat bars 41, 42. Triangular levers 37, 38 each have three shafts 43, 44, 45 or 46, 47, 48. Shafts 43 and 46 are arranged rotating only at angle section 12. Rotating shafts 44 and 47 each represent a rotating and movable connection between triangular levers 37 or 38 and a curved lever 39 or 40. Rotating shafts 45 and 48 each represent a rotating and movable connection between triangular levers 37 or 38 and one end of flat bar 41 or 42, whereby the other end of flat bar 42 is also connected to shaft 45, and the other end of flat bar 41 is connected to shaft 14. Flat curved levers 39 and 40 are severely curved, in order to provide a free space for the heads of shafts 45 or 48. The other ends of curved shafts 39, 40 each rotate around another shaft 49, 50 and are flexibly connected with contact 35.

The binding machine constructed in accordance to FIG. 3 functions as follows.

When punch lever 6 is in an upper position, corresponding to the position represented in the figure, rods 41 and 42 are moved to the left, and shafts 44 and 47 are located in their highest position. Preferably, shafts 44 and 47 are located on the fixed plane defined by shafts 43 and 46, or even a little higher. On rotating punch lever 6 downward around firmly attached shaft 13, shaft 14 and rods 41 and 42 connected with it (FIG. 3) are moved to the right. This causes triangular lever 37 and 38 to rotate around firmly supported shafts 43 and 46, whereby curved levers 39 and 40 and pressing element 35 connected to them are pressed downward.

This part of the machine accordingly serves to press a clamping back, especially made of wire, lying on part 31, located under pressing element 35.

Figure 4:
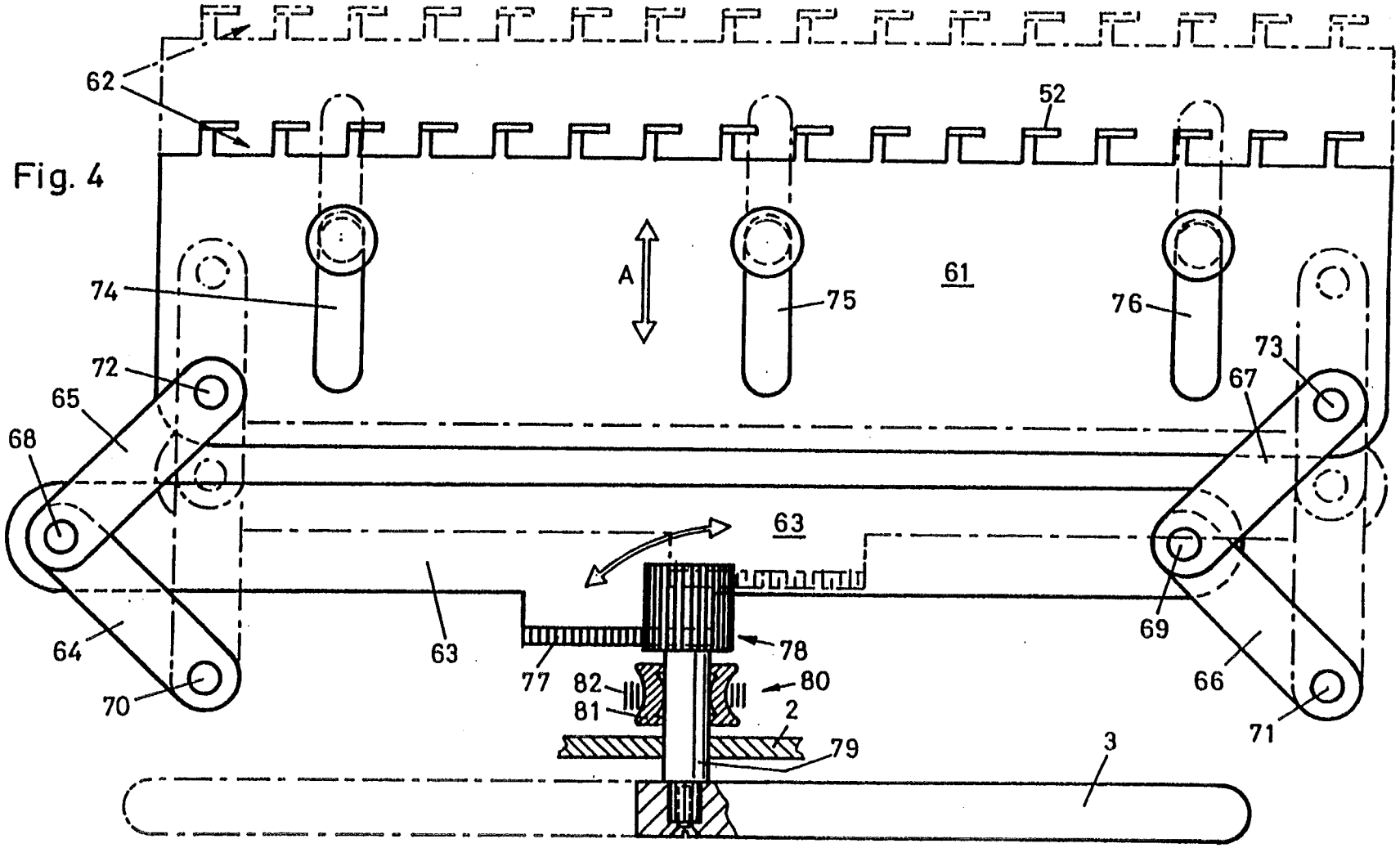
FIG. 4 is a schematic top view of the spreader device according to the invention.
Figure 5:
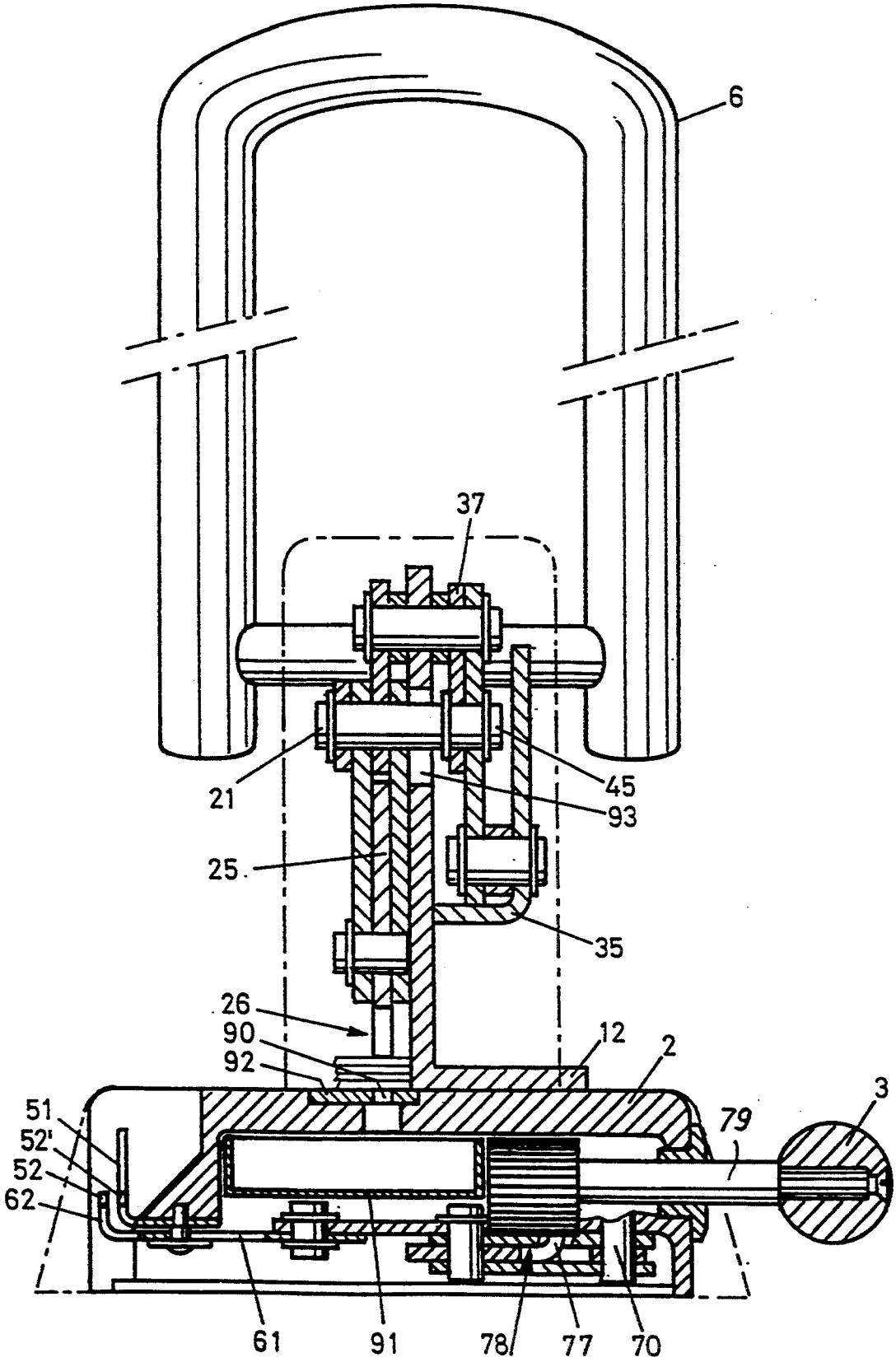
FIG. 5 is a cross-sectional representation of another variant of such a combined punch and binding machine constructed and arranged in accordance with the invention.

The design of the actual spreading device according to the invention is partially shown in FIG. 4. N Vertical fingers 51 shown in FIG. 5 are permanently attached to bottom element 2 shown in FIG. 2. Each finger 51 is formed in its lower area with a short horizontal pin 52' (FIG. 5). Fingers 51 are not shown in FIG. 4, to simplify the drawing.

FIG. 4 shows movable ratchet plate 61, consisting of a flat elongated sheet part, provided with N hooks 62 in its front area on its longitudinal edge. As is seen in FIG. 2 and 4, these hooks 62 are designed three-dimensionally, so that, in reference to the view according to FIG. 2, they present a first short section extending horizontally to the front, a second short section extending vertically upward, and a third short section extending horizontally to the left. The horizontal part 52 of hooks 62 corresponds in dimensions to the horizontal pin of fingers 51 (FIG. 2). Horizontal part 52 is therefore located precisely in front of the horizontal part of corresponding stationary finger 51, invisible in FIG. 2.

The spreading device of FIG. 4 includes a lever system with an elongated flat bar 63 and four arms 64, 65, 66 and 67 pivotally connected with it. Arms 64 and 65 are jointly connected through a shaft 68 with one end and arms 66 and 67 are jointly connected through a shaft 69 with the other end of flat bar 63. Arms 64 and 66 are each pivotally connected at their other end to shafts 70 or 71 which are firmly attached to bottom element 2. The anchoring of shafts 70 and 71 to bottom element 2 is not shown, to simplify the figure. Arms 65 and 67 are each pivotally and movably connected at their other free end, through shafts 72 and 73, with one end of the rear area of ratchet plate 61, which is formed with elongated openings 74, 75 and 76, which serve for guiding ratchet plate 61 in a movement from back to front and vice versa.

Ratchet plate 61 is accordingly mounted by means of bolts and screws with ring sliding in bottom element 2. Flat bar 63 is provided with teeth which form toothed rack 77, which collaborates with pinion 78, mounted on a pinion shaft 79 which is supported at bottom element 2 (FIG. 1) in a way not illustrated in detail, to simplify the drawing. In another modification of the design in accordance with the invention, a brake 80 can be present. This is to prevent the return movement of shaft 79 of pinion 78, which can act against the spring force of a clamping back. Shaft 79 of the pinion is rotated manually by spreading lever 3. Brake 80 can include, for example, a sleeve 81 made of elastic material, with an inside recess and a strip spring 82 rolled outside on the sleeve. Due to the pressure of strip spring 82, sleeve 81 is deformed in its central area, which produces a braking effect by friction against the rough surface of shaft 79. This brake can be useful with the use of ridge-shaped punched plastic binder backs.

The spreading device as shown in FIGS. 2 and 4 functions as follows. When spreading lever 3 is rotated upward, pinion 78 moves toothed rack 77 and therefore also shafts 68 and 69 to the right. This causes a shift of ratchet plate 61 to the rear and, accordingly, also a spreading of fingers 51 and hooks 62. A crescent-shaped clamping back held in a closed state between fingers 51 and hooks 62 can therefore quite easily be spread with a simple movement of spreading lever 3, to open it and then bind the sheets of pages. Instead of a pinion, flat bar 63 can also be activated by means of a preferably vertical movable handle rigidly connected to it. Such a handle can be connected at the side, as illustrated in FIG. 4, or at the front with an longation of flat bar 63. Flat bar 63 can also be moved by means of a crank and screw with an axis running parallel to the longitudinal axis of flat bar 63.

FIG. 5 illustrates a design for a combined punch and binding machine with punch lever 6 designed in a U-shape, bottom element 2 with punch holes 90, L-shaped angle section 12, plate bent at right angle with fingers 51, ratchet 61 with hooks 62, pinion 78 with toothed rack 77, punching element 25 with punch teeth 26, L-shaped contact 35, and spreading lever 3. It is seen from FIG. 5 that, for example, shaft 70 (and 71) is firmly attached to bottom element 2. A box 91 is provided to take up the holed paper residues. Box 91 can be pulled out from the rear of bottom element 2. Punch holes 90 can be located in a punch hole plate 92 to facilitate a change in size or shape.

It is also seen from FIG. 5 that shaft 45 (FIG. 3) can be an extension of shaft 21 (FIG. 2), or shaft 48 (FIG. 3) an extension of shaft 22 (FIG. 2), if corresponding recesses 92 are present in angle section 12, to make movement of the shafts (21, 45 or 22, 48) possible.

Punch lever 6 (FIG. 5 and FIG. 1) could also be somewhat bent in the area of its shaft.

To simplify the drawing, the ends of punch teeth 26 represent a straight line in FIG. 1. However, these ends preferably form a stepped line. For example, the teeth can be shorter in the central area of punching element 25 in the end areas.

It will thus be seen that the objects set forth above, among those made apparent from the preceding description, are efficiently attained and, since certain changes may be made in the above construction(s) without departing from the spirit and scope of the invention, it is intended that all matter contained in the above description or shown in the accompanying drawing(s) shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A spreading device for a binding apparatus comprising;

a plurality of parallel spaced apart spreading fingers (51) arranged rigidly in a row on a base body (2);

a movable plate (61) having a plurality of parallel spreading hooks (62) cooperating with the spreading fingers in order to remove the spreading hooks from the spreading fingers in the spreading device by moving the plate in a spreading direction (A);

an elongated bar (63) and movable arm (65, 67) having first ends and second ends, said first ends being pivotally connected to each end of the bar and said second ends being pivotally connected to said plate, thereby connecting said plate (61) to the bar (63) through the two movable arms (65, 67) so that the arms and plate can move in the spreading direction (A) and in a direction perpendicular to the spreading direction; and two arms (64, 66) having first ends and seconds ends, said first ends being pivotally connected to each end of said bar (63) at essentially the same point as said movable arms (65, 67) and said second ends of said arms (64, 66) being pivotally connected to said base body (2).

2. A spreading device for a binding apparatus comprising:

a plurality of parallel spaced apart spreading fingers (51) arranged rigidly in a row on a base body (2);

a movable plate (61) having a plurality of parallel spreading hooks (62) cooperating with the spreading fingers in order to remove the spreading hooks from the spreading fingers by moving the plate in a spreading direction (A);

an elongated bar (63) and a movable arm (65, 67) pivotally connected to each end of the bar and said plate (61) connected with the bar 63 through the two movable arms (65, 67) so that the arms and plate can move in a spreading direction (A) and in a direction perpendicular to the spreading direction;

two arms (64, 66) having first and second ends, said first ends of said arms (64, 67) being pivotally connected to each end of said bar (63) and said second ends of said arms (64, 67) being pivotally connected to base body (2); and an operating lever (3) and a pinion (78) rotatable about an axis and mounted on the lever, said bar (63) having a toothed rack (77) for cooperating with the pinion (78), said toothed rack (77) being movable along said pinion axis without separating from said pinion, said pinion being rotatably attached to said base body (2).

3. The spreading device of claim 2, wherein said pinion (78) includes a shaft (79) connected to the lever (3) and a braking device (80) mounted to the shaft (79).

4. A combined punch and binding apparatus for binding a plurality of sheets, comprising:

a bottom element (2);

punch means including a vertically movable punching element (25) mounted on said bottom element (2) for punching openings in the sheets to be bound;

a spreading device including a plurality of parallel spaced apart spreading fingers arranged rigidly in a row on the bottom element;

a movable plate having a plurality of parallel spreading hooks for cooperating with the spreading fingers in order to move the spreading hooks from the spreading fingers in a spreading direction (A) by moving the plate;

a bar (63) and moveable arms (65, 67) having first ends and second ends, said first ends being pivotally connected to each end of the bar and said second ends being pivotally connected to said plate (61), thereby pivotally connecting said plate to the bar (63) by the two rotatable and movable arms (65, 67) so that the arms can move in the spreading direction (A) and in a direction perpendicular to the spreading direction; and two arms (64, 66) having first ends and second ends, said first ends being pivotally connected to each end of said bar (63) as essentially the same point at said movable arms (65, 67) and said second ends of said arms (64, 66) being pivotally connected to said bottom element (2).

5. The binding apparatus of claim 4, further including vertically displaceable pressing means (35) for pressing clamping elements and a carrier for vertically guiding said pressing means.

6. The binding apparatus of claim 4, further including two shafts (29, 30) and levers (16, 19) connected to said shafts, and a carrier flange (12) connected with said bottom element (2) by said levers (16, 19) to which said punching element (25) is held.

7. The binding apparatus of claim 6, wherein the carrier flange (12) is an angle section having an L-shaped cross-section.

8. The binding apparatus of claim 4, further including a removable elongated box (91) located beneath the punch means.

9. The binder apparatus of claim 4, further including a curved lever (6) for operating said punch means.

* * * * *